US010433607B2

(12) United States Patent
Ahn

(10) Patent No.: US 10,433,607 B2
(45) Date of Patent: Oct. 8, 2019

(54) KNOT-FREE MULTI-LAYERED EYELASH AND METHOD FOR CREATING THE SAME

(71) Applicant: Kiss Nail Products, Inc., Port Washington, NY (US)

(72) Inventor: Ki Chul Ahn, Port Washington, NY (US)

(73) Assignee: Kiss Nail Products, Inc., Port Washington, NY (US)

( * ) Notice: Subject to any disclaimer, the term of this patent is extended or adjusted under 35 U.S.C. 154(b) by 650 days.

(21) Appl. No.: 15/187,222

(22) Filed: Jun. 20, 2016

(65) Prior Publication Data

US 2017/0360135 A1 Dec. 21, 2017

(51) Int. Cl.
*A41G 3/00* (2006.01)
*A41G 5/02* (2006.01)

(52) U.S. Cl.
CPC ..... *A41G 5/02* (2013.01)

(58) Field of Classification Search
CPC ..... A41G 5/02
USPC ..... 132/201
See application file for complete search history.

(56) References Cited

U.S. PATENT DOCUMENTS 3,032,042 A * 5/1962 Meehan ..... A41G 5/02 132/201
4,299,242 A * 11/1981 Choe ..... A41G 5/02 132/53
5,547,529 A * 8/1996 Woolf ..... A41G 5/02 132/201
2005/0061341 A1* 3/2005 Choe ..... A41G 5/02 132/53

* cited by examiner

*Primary Examiner* — Rachel R Steitz

(57) ABSTRACT

The present disclosure is directed to a method for creating a knot-free multi-layered eyelash. In one embodiment, the method includes coupling a first false eyelash having a first row of knots on top of a second false eyelash having a second row of knots via an adhesive applied to the first row of knots and the second row of knots, securing the first false eyelash and the second false eyelash that are coupled together via the adhesive between a first band and a second band located adjacent to the adhesive, coating the first false eyelash and the second false eyelash with a liquid adhesive along the first band and the second band and cutting away the adhesive to create the knot-free multi-layered eyelash.

19 Claims, 4 Drawing Sheets

KNOT-FREE MULTI-LAYERED EYELASH AND METHOD FOR CREATING THE SAME

BACKGROUND

False eyelashes are used by many women to enhance a look or appearance of the eyes. False eyelashes can be made from a variety of different methods and materials. Typically, the materials are knotted together in groups of fibers to create the false eyelashes. The density of the fibers, the spacing of the knots, and the like, can be varied to create a variety of different false eyelash designs.

However, some designs and styles are difficult to create from a single row of knotted groups of fibers. Simply combining two false eyelashes that have rows of knots would not be desirable as the knots would add bulk and thickness to the false eyelashes. The additional bulk and thickness may detract from the overall appearance of the false eyelash when applied and make the false eyelash difficult to apply due to the size and weight.

SUMMARY

In one embodiment, the present disclosure provides a method for creating a knot-free multi-layered eyelash. In one embodiment, the method comprises coupling a first false eyelash having a first row of knots on top of a second false eyelash having a second row of knots via an adhesive applied to the first row of knots and the second row of knots, securing the first false eyelash and the second false eyelash that are coupled together via the adhesive between a first band and a second band located adjacent to the adhesive, coating the first false eyelash and the second false eyelash with a liquid adhesive along the first band and the second band and cutting away the adhesive to create the knot-free multi-layered eyelash.

In one embodiment, the present disclosure provides another method for creating a knot-free multi-layered eyelash. The method comprises placing a first false eyelash on an adhesive, applying a double sided adhesive on the first false eyelash, placing a second false eyelash on the double sided adhesive on top of the first false eyelash and on an opposite side of the double sided adhesive, securing, via a second adhesive on a tool comprising two poles, the first false eyelash and the second false eyelash that are coupled together by the double sided adhesive on the tool and on top of a first string coupled between the two poles, securing a second string between the two poles on top of the first false eyelash and the second false eyelash that are coupled together by the double sided adhesive, applying a glue to portions of the first false eyelash and the second false eyelash located between the first string and the second string and cutting away the adhesive and the double sided adhesive to create the knot-free multi-layered eyelash.

In another embodiment, the present disclosure provides another method for creating a knot-free multi-layered eyelash. The method comprises placing a first layer of double sided tape, placing a first layer of single sided tape on top of the first layer of double sided tape such that an adhesive side of the first layer of single sided tape is facing upward, securing a first row of knots of a first false eyelash on top of the adhesive side of the first layer of single sided tape, placing a second layer of double sided tape on top of the first row of knots of the first false eyelash, securing a second row of knots of a second false eyelash on the second layer of double sided tape on top of the first row of knots of the first false eyelash and on an opposite side of the second layer of double sided tape, applying a second layer of single sided tape such that an adhesive side of the second layer of single sided tape covers the second row of knots of the second false eyelash, securing, via a third layer of double sided tape on a tool comprising two poles, the first false eyelash and the second false eyelash that are coupled together on the tool and on top of a first string coupled between the two poles, securing a second string between the two poles on top of the first false eyelash and the second false eyelash that are coupled together, applying a glue to portions of the first false eyelash and the second false eyelash located between the first string and the second string and cutting away the first layer of double sided tape, the first layer of single sided tape, the second layer of double sided tape and the second layer of single sided tape to create the knot-free multi-layered eyelash.

BRIEF DESCRIPTION OF THE DRAWINGS

So that the manner in which the above recited features of the present disclosure can be understood in detail, a more particular description of the disclosure, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

Embodiments of the present disclosure provide a knot-free multi-layered eyelash and method for creating the same. As discussed above, false eyelashes are used by many women to enhance a look or appearance of the eyes. False eyelashes can be made from a variety of different methods and materials. Typically, the materials are knotted together in groups of fibers to create the false eyelashes. The density of the fibers, the spacing of the knots, and the like, can be varied to create a variety of different false eyelash designs.

However, some designs and styles are difficult to create from a single row of knotted groups of fibers. Simply combining two false eyelashes that have rows of knots would not be desirable as the knots would add bulk and thickness to the false eyelashes. The additional bulk and thickness may detract from the overall appearance of the false eyelash when applied to an eyelid and make the false eyelash difficult to apply due to the size and weight.

Embodiments of the present disclosure provide a method to combine different eyelash designs and styles into a single combined knot-free multi-layered eyelash. As a result, hundreds and thousands of new designs can be created by combining multiple different styles of false eyelashes. In addition, the different styles of false eyelashes can be combined without adding the weight and bulk of the knots of each false eyelash.

Figure 1:
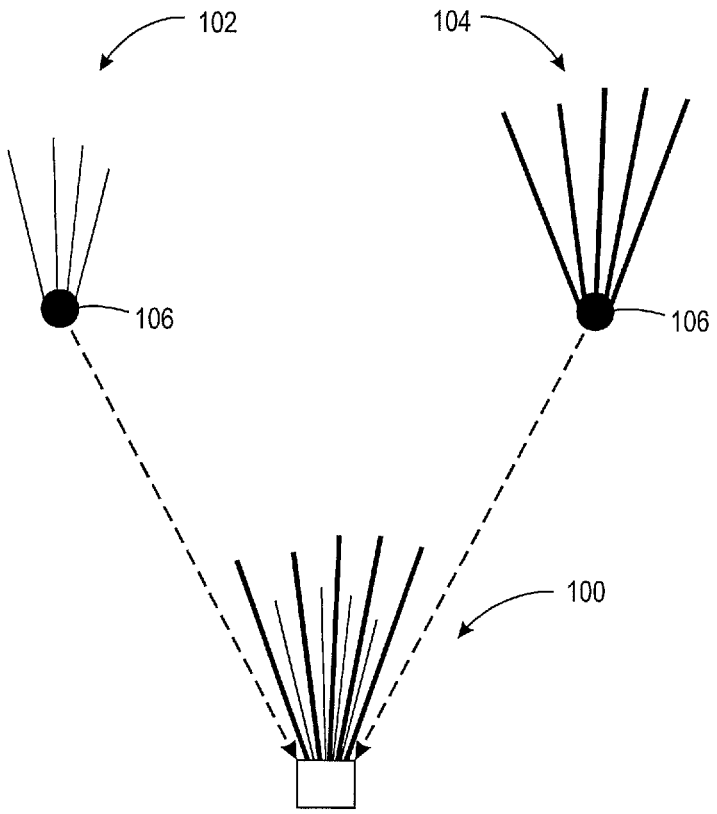
FIG. 1 depicts an example view of a knot-free multi-layered eyelash.

FIG. 1 illustrates an example of a knot-free multi-layered eyelash 100. In one embodiment, the knot-free multi-layered eyelash 100 may be formed by combining a first false eyelash 102 and a second false eyelash 104. In one embodiment, the first false eyelash 102 and the second false eyelash 104 may each be a different design. Although two different eyelash designs are used, in some embodiments more than two different eyelash designs (e.g., three or more) can be combined to form the knot-free multi-layered eyelash 100.

In one embodiment, the first false eyelash 102 and the second false eyelash 104 may be comprised of synthetic fibers. In one embodiment, the first false eyelash 102 and the second false eyelash 104 may be comprised of human hair. In one embodiment, the first false eyelash 102 and the second false eyelash 104 may be a combination of synthetic fibers and human hair.

FIG. 1 illustrates the first false eyelash 102 and the second false eyelash 104 each having a respective knot 106 and 108. FIG. 1 has been simplified, but the first false eyelash 102 may have a row of knots 106 for a complete false eyelash. Similarly, the second false eyelash 104 may also have a row of knots 108 for a complete false eyelash. However, using the embodiments of the present disclosure, when the first false eyelash 102 and the second false eyelash 104 are combined to form the knot-free multi-layered eyelash 100 the row of knots 106 and 108 are removed.

Figure 2:
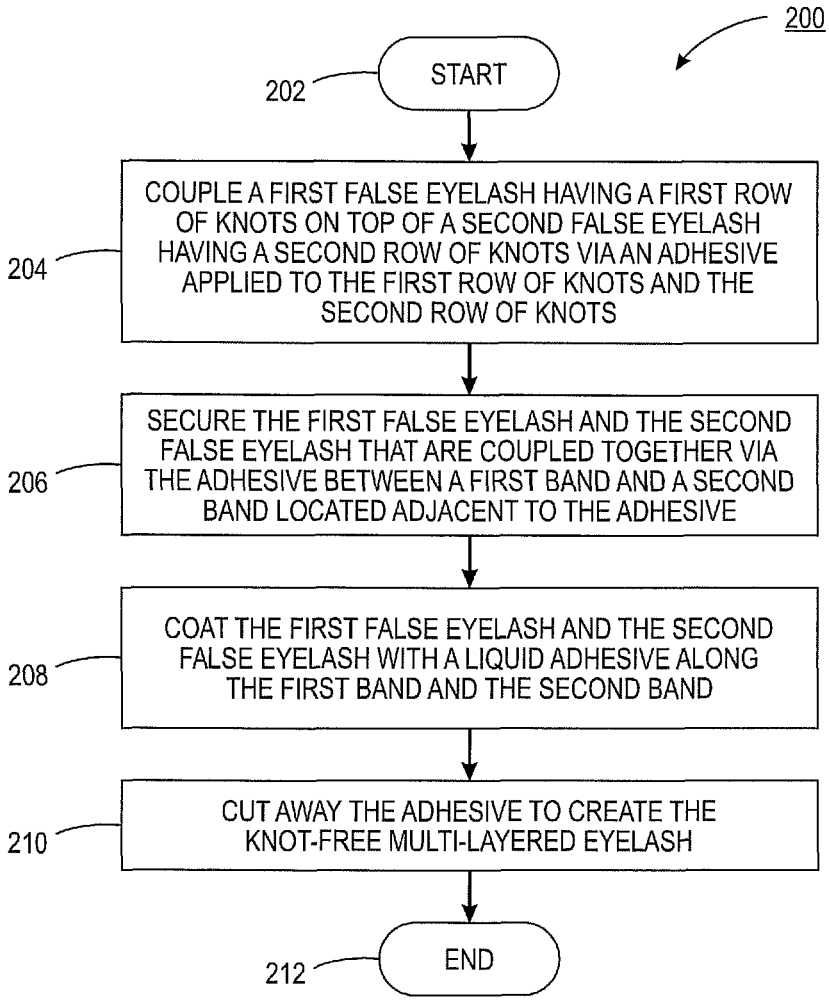
FIG. 2 depicts a flow chart of an example method for creating the knot-free multi-layered eyelash.

FIG. 2 illustrates a flowchart of a method 200 for creating the knot-free multi-layered eyelash. The method 200 may be automated by a machine or robotic arm. In other words, a non-transitory computer readable medium (e.g., a memory, hard disk drive, and the like) may store the instructions of the method 200 that are executed by a processor. The processor may be in communication with a machine or robotic arm and the instructions of the method 200 may control the machine or robotic arm.

The method 200 begins at block 202. At block 204, the method 200 couples a first false eyelash having a first row of knots on top of a second false eyelash having a second row of knots via an adhesive applied to the first row of knots and the second row of knots. In one embodiment, the first false eyelash and the second false eyelash may be different designs or styles.

In one embodiment, the second row of knots may be placed directly on top of the first row of knots. In another embodiment, the second row of knots and the first row of knots may be placed in an alternating fashion.

In one embodiment, the adhesive may be a tape. For example, the adhesive may be a double-sided tape that may attach to both the first row of knots and the second row of knots. The first false eyelash and the second false eyelash may be coupled onto the adhesive by placing the knots on the adhesive just below an edge of the adhesive. In other words, a minimum amount of the lashes should come into contact with the adhesive. Said another way, only the first row of knots and the second row of knots should contact the adhesive.

At block 206, the method 200 secures the first false eyelash and the second false eyelash that are coupled together via the adhesive between a first band and a second band located adjacent to the adhesive. In one embodiment, the first band and the second band may be string attached to a tool having two poles on opposite sides. The first band and the second band may be located directly on top of one another with the first false eyelash and the second false eyelash that are coupled together positioned between the first band and the second band. In another embodiment, the first band and the second band may be offset from one another.

At block 208, the method 200 coats the first false eyelash and the second false eyelash with a liquid adhesive along the first band and the second band. In one embodiment, the liquid adhesive may be a glue. The glue may be applied to the lash portions between the first band and the second band. In one embodiment, the glue may be applied from a back side to a front side.

At block 210, the method 200 cuts away the adhesive to create the knot-free multi-layered eyelash. For example, after the liquid adhesive has dried, the knots may be cut away from the eyelash. As a result, the first false eyelash and the second false eyelash are held together via the liquid glue, the first band and the second band.

In one embodiment, the knot-free multi-layered eyelash may be trimmed. For example, when the first band and the second band are cut to release the knot-free multi-layered eyelash from the tool an excess amount of the bands may remain on the outside ends (e.g., along a width) of the eyelash. As a result, the excess amount of the first band and the second band that are outside a width of the knot-free multi-layered eyelash may be trimmed. At block 212, the method 200 ends.

Figure 3:
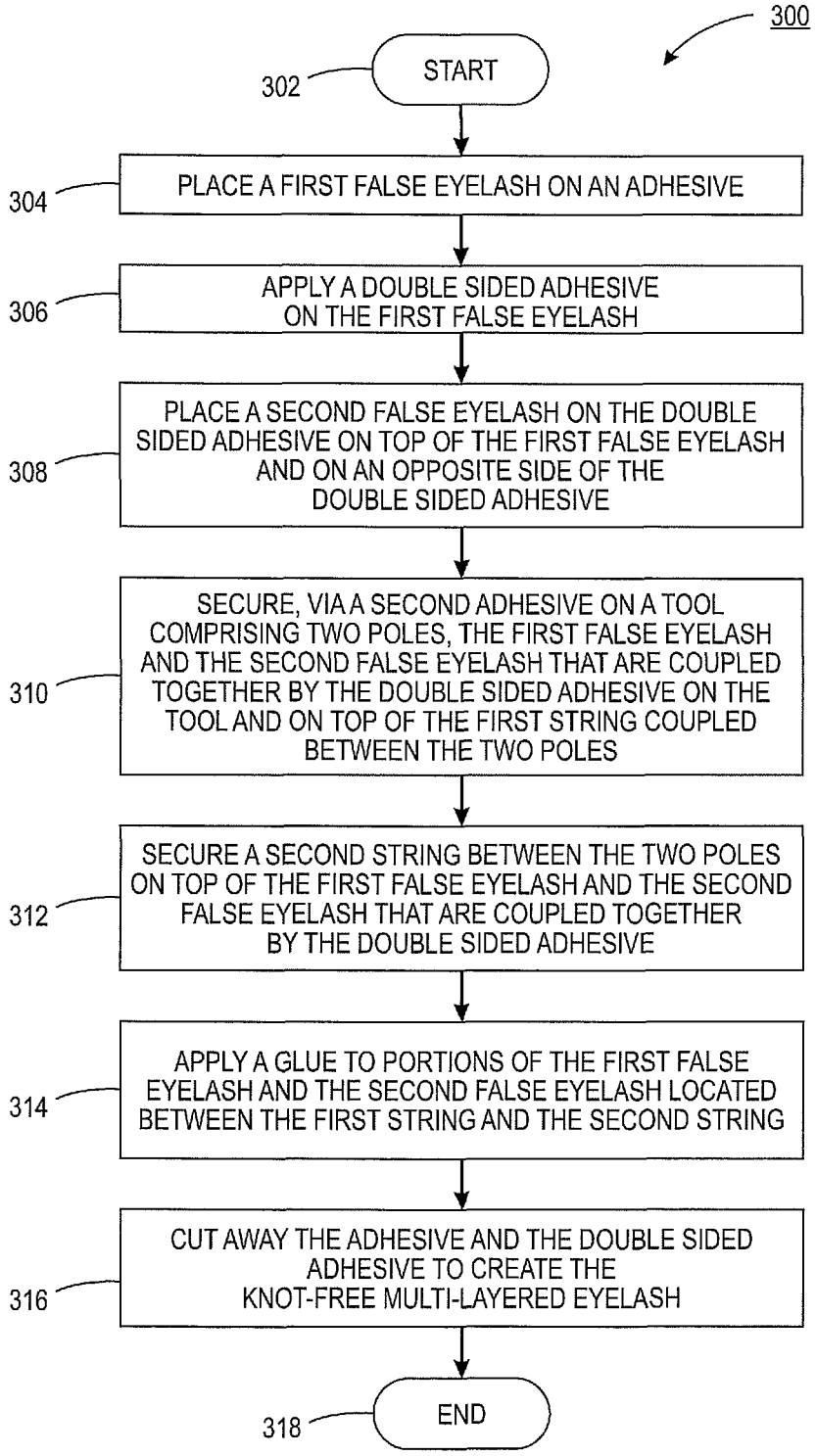
FIG. 3 depicts a flow chart of a second example method for creating the knot-free multi-layered eyelash.

FIG. 3 illustrates a flowchart of a method 300 for creating the knot-free multi-layered eyelash. The method 300 may be automated by a machine or robotic arm. In other words, a non-transitory computer readable medium (e.g., a memory, hard disk drive, and the like) may store the instructions of the method 300 that are executed by a processor. The processor may be in communication with a machine or robotic arm and the instructions of the method 300 may control the machine or robotic arm.

The method 300 begins at block 302. At block 304, the method 300 places a first false eyelash on an adhesive. In one embodiment, the adhesive may be a single sided adhesive. The first false eyelash may be placed on an adhesive side of the single sided adhesive. In one embodiment, the first false eyelash may be placed on the adhesive such that only a first row of knots of the first false eyelash contact the adhesive. In other words, a minimum amount of the lashes should contact the adhesive. Said another way, the edge of the adhesive should be located just above the first row of knots.

At block 306, the method 300 applies a double sided adhesive on the first false eyelash. For example, the double sided adhesive may be applied to the first row of knots of the first false eyelash. In one embodiment, the double sided adhesive may be applied to the first row of knots of the first false eyelash such that only the first row of knots of the first false eyelash contact the double sided adhesive. In other words, a minimum amount of the lashes should contact the double sided adhesive. Said another way, the edge of the double sided adhesive should be located just above the first row of knots.

At block 308, the method 300 places a second false eyelash on the double sided adhesive on top of the first false eyelash and on an opposite side of the double sided adhesive. In one embodiment, the second false eyelashes may have a different design or style than the first false eyelash. In one embodiment, the second false eyelash may be placed on the double sided adhesive such that a second row of knots of the second false eyelash are directly on top of the first row of knots of the first false eyelash on opposing sides of the double sided adhesive.

At block 310, the method 300 secures, via a second adhesive on a tool comprising two poles, the first false eyelash and the second false eyelash that are coupled together by the double sided adhesive on the tool and on top of a first string coupled between the two poles. For example, the first string may be pulled taut between the two poles of the tool. The first string may be located just above the first row of knots and the second row of knots to maximize a length of the lashes after the knots are removed, as discussed below.

In one embodiment, the second adhesive may be a double sided tape. For example, the second adhesive may be attached to a flat side of the tool. Then, the first false eyelash and the second false eyelash that are coupled together onto the second adhesive and against the first string.

At block 312, the method 300 secures a second string between the two poles on top of the first false eyelash and the second false eyelash that are coupled together by the double sided adhesive. For example, the second string may also be pulled taught between the two poles. In one embodiment, the second string may be located directly on top of the first string. In another embodiment, the second string may be located offset relative to the first string.

At block 314, the method 300 applies a glue to portions of the first false eyelash and the second false eyelash located between the first string and the second string. In one embodiment, the glue may be applied from a back side to a front side. For example, the glue may be applied on one side. Then the tool may be flipped and glue may be applied on the opposite side.

At block 316, the method 300 cuts away the adhesive and the double sided adhesive to create the knot-free multi-layered eyelash. For example, after the glue has dried, the knots may be cut away from the eyelash. As a result, the first false eyelash and the second false eyelash are held together via the glue, the first string and the second string.

In one embodiment, the knot-free multi-layered eyelash may be trimmed. For example, when the first string and the second string are cut to release the knot-free multi-layered eyelash from the tool an excess amount of string may remain on the outside ends (e.g., along a width) of the eyelash. As a result, the excess amount of the first string and the second string that are outside a width of the knot-free multi-layered eyelash may be trimmed. At block 318, the method 300 ends.

Figure 4:
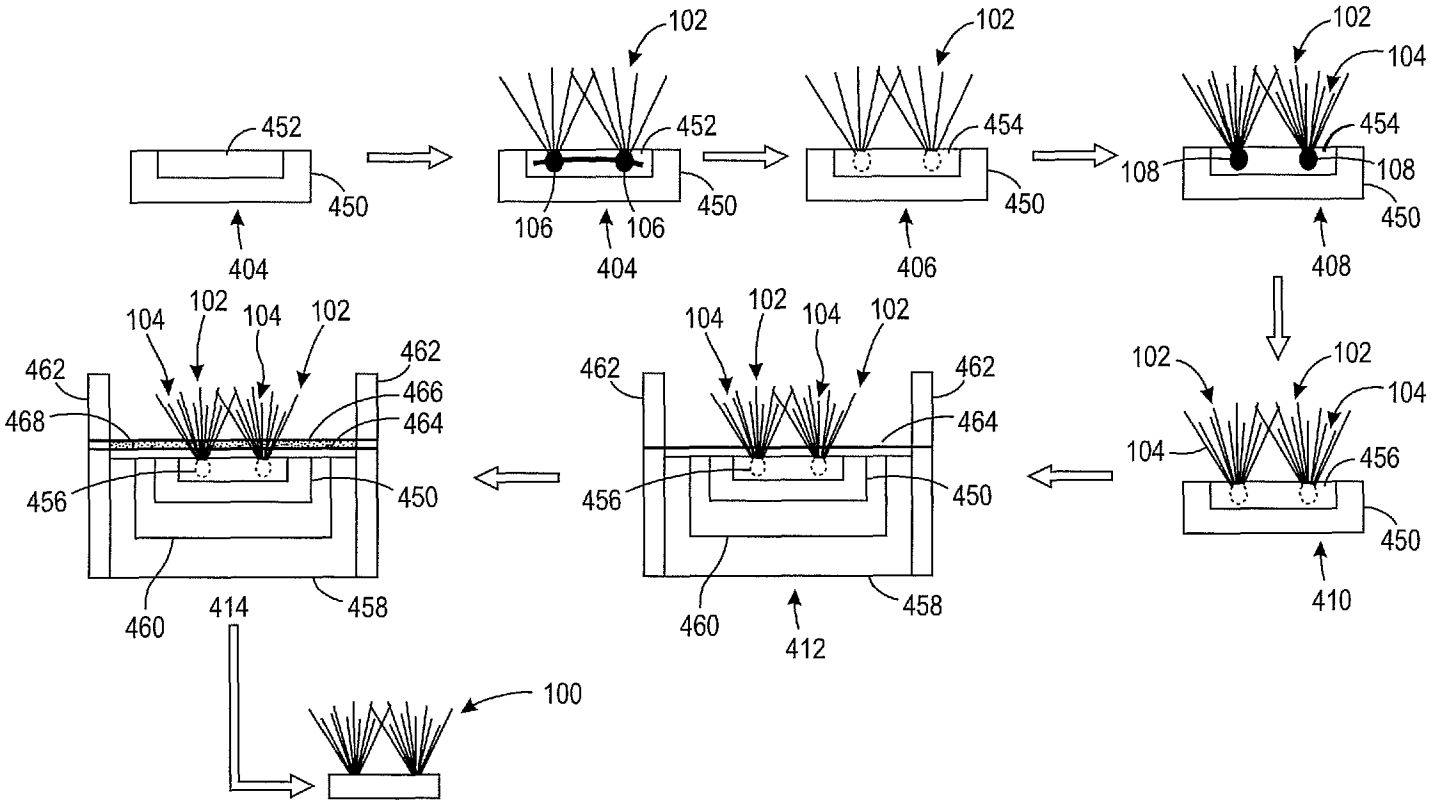
FIG. 4 depicts a process flow diagram of a method for creating the knot-free multi-layered eyelash.

FIG. 4 illustrates a process flow diagram of a method 400 for creating the knot-free multi-layered eyelash. The method 400 begins at block 402. At block 402, the method 400 places a first layer of single sided tape 452 on top of a first layer of double sided tape 450.

At block 404, the method 400 secures a first row of knots 106 of a first false eyelash 102 on top of an adhesive side of the first layer of single sided tape 452. The edge of the first layer of single sided tape 452 may be located just above where the knot 106 meets the lashes.

At block 406, the method 400 places a second layer of a double sided tape 454 on top of the first row of knots of the first false eyelashes. For example, an edge of the double sided tape 454 may be located just above where the knot 106 meets the lashes. The knots 106 are illustrated as dashed lines hidden beneath the second layer of double sided tape 454.

At block 408, the method 400 secures a second row of knots 108 of a second false eyelash 104 on the second layer of double sided tape 454 on top of the first row of knots 106 of the first false eyelash 102 and on an opposite side of the second layer of the double sided tape 454. The edge of the second layer of double sided tape 454 may be located just above where the knot 108 meets the lashes.

In one embodiment, the second false eyelash 104 may be a different design or style than the first false eyelash 102. For example, in FIG. 4, the first false eyelash 102 may have five equal length lashes. The second false eyelash 104 may have four different length lashes that are shorter than the lashes of the first false eyelash 102. Although the designs are simplified for the drawings and ease of explanation. For example, typical false eyelashes may have hundreds of lashes per knot of varying thickness, length, curvature, and the like.

In one embodiment, the second row of knots 108 may be located directly above the first row of knots 106. For example, the dashed lines from block 406 are not seen beneath the second row of knots 108.

At block 410, the method 400 applies a second layer of single sided tape such that an adhesive side of the second layer of single sided tape covers the second row of knots 108 of the second false eyelash 104. For example, dashed lines 456 in block 410 illustrate the second row of knots 108 hidden beneath the second layer of single sided tape. The edge of the second layer of single sided tape may be located just above where the knot 108 meets the lashes.

At block 412, the method 400 secures the first false eyelash 102 and the second false eyelash 104 that are coupled together to a third layer of double sided tape 460 that is located on a tool 458. The tool 458 may have two poles 462 on opposite sides of the tool 458. A string (or band) 464 may be secured and taut between the two poles 462. The first false eyelash 102 and the second false eyelash 104 that are coupled together may be secured via the third layer of double sided tape 460 and on top of the first string 464.

At block 414, the method 400 may secure a second string 466 between the two poles 462 and on top of the first false eyelash 102 and the second false eyelash 104 that are coupled together. The second string 466 may also be secured and taut between the two poles 462.

In one embodiment, the second string 466 may be placed directly on top of the first string 464. In other words, when looking down on FIG. 4, the first string 464 would not be seen below the second string 466. In another embodiment, the second string 466 may be placed offset from the first string 464 (e.g., higher or lower on the poles 462 than the first string 464).

In one embodiment, a glue 468 may be applied to the portions of the first false eyelash 102 and the second false eyelash 104 that are located between the first string 464 and the second string 466. In one embodiment, the glue 468 may be applied from a back side (e.g., a side away from the reader) to a front side (e.g., a side closer to the reader).

At block 414, the method 400 may cut away the first layer of double sided tape, the first layer of singe sided tape, the second layer of double sided tape and the second layer of single sided tape to create the knot-free multi-layered eyelash 100. In other words, after the glue dries, the adhesive layers containing the first row of knots 106 and the second row of knots 108 may be cut away from the first string 464 and the second string 466. The remaining lash may be the knot-free multi-layered eyelash 100. The method 400 ends at block 414.

While various embodiments have been described above, it should be understood that they have been presented by way of example only, and not limitation. Thus, the breadth and scope of a preferred embodiment should not be limited by any of the above-described exemplary embodiments, but should be defined only in accordance with the following claims and their equivalents.

What is claimed is:

1. A method for creating a knot-free multi-layered eyelash, comprising:

coupling a first false eyelash having a first row of knots on top of a second false eyelash having a second row of knots via an adhesive applied to the first row of knots and the second row of knots;

securing the first false eyelash and the second false eyelash that are coupled together via the adhesive between a first band and a second band located adjacent to the adhesive, wherein the securing comprises:

securing the first band between two poles of a tool;

applying the first false eyelash and the second false eyelash that are coupled together on the tool with a second adhesive on top of the first band; and securing the second band between the two poles of the tool on top of the first false eyelash and the second false eyelash that are coupled together;

coating the first false eyelash and the second false eyelash with a liquid adhesive along the first band and the second band; and cutting away the adhesive to create the knot-free multi-layered eyelash.

2. The method of claim 1, wherein the second row of knots is placed directly on top of the first row of knots.

3. The method of claim 1, wherein the first false eyelash and the second false eyelash comprise different false eyelash designs.

4. The method of claim 1, wherein the adhesive comprises tape.

5. The method of claim 1, wherein the adhesive is applied such that only the first row of knots and the second row of knots are covered by the adhesive.

6. The method of claim 1, wherein the liquid adhesive comprises a glue.

7. The method of claim 6, wherein the glue is applied from a back side to a front side.

8. The method of claim 1, further comprising:

trimming an excess amount of the first band and the second band that are outside a width of the knot-free multi-layered eyelash.

9. A method for creating a knot-free multi-layered eyelash, comprising:

placing a first false eyelash on an adhesive;

applying a double sided adhesive on the first false eyelash;

placing a second false eyelash on the double sided adhesive on top of the first false eyelash and on an opposite side of the double sided adhesive;

securing, via a second adhesive on a tool comprising two poles, the first false eyelash and the second false eyelash that are coupled together by the double sided adhesive on the tool and on top of a first string coupled between the two poles;

securing a second string between the two poles on top of the first false eyelash and the second false eyelash that are coupled together by the double sided adhesive;

applying a glue to portions of the first false eyelash and the second false eyelash located between the first string and the second string; and cutting away the adhesive and the double sided adhesive to create the knot-free multi-layered eyelash.

10. The method of claim 9, wherein the first false eyelash comprises a first row of knots and the second false eyelash comprises a second row of knots and the second row of knots is aligned with the first row of knots when the second false eyelash placed on the double sided adhesive.

11. The method of claim 10, wherein the adhesive and the double sided adhesive is applied such that only the first row of knots and the second row of knots are covered.

12. The method of claim 9, wherein the first false eyelash and the second false eyelash comprise different false eyelash designs.

13. The method of claim 9, wherein the adhesive comprises a tape.

14. The method of claim 9, wherein the second adhesive comprises a double sided tape.

15. The method of claim 9, wherein the glue is applied from a back side to a front side.

16. The method of claim 9, further comprising:

trimming an excess amount of the first string and the second string that are outside a width of the knot-free multi-layered eyelash.

17. A method for creating a knot-free multi-layered eyelash, comprising:

placing a first layer of double sided tape;

placing a first layer of single sided tape on top of the first layer of double sided tape such that an adhesive side of the first layer of single sided tape is facing upward;

securing a first row of knots of a first false eyelash on top of the adhesive side of the first layer of single sided tape;

placing a second layer of double sided tape on top of the first row of knots of the first false eyelash;

securing a second row of knots of a second false eyelash on the second layer of double sided tape on top of the first row of knots of the first false eyelash and on an opposite side of the second layer of double sided tape;

applying a second layer of single sided tape such that an adhesive side of the second layer of single sided tape covers the second row of knots of the second false eyelash;

securing, via a third layer of double sided tape on a tool comprising two poles, the first false eyelash and the second false eyelash that are coupled together on the tool and on top of a first string coupled between the two poles;

securing a second string between the two poles on top of the first false eyelash and the second false eyelash that are coupled together;

applying a glue to portions of the first false eyelash and the second false eyelash located between the first string and the second string; and cutting away the first layer of double sided tape, the first layer of single sided tape, the second layer of double sided tape and the second layer of single sided tape to create the knot-free multi-layered eyelash.

18. The method of claim 17, wherein the first false eyelash and the second false eyelash comprise different false eyelash designs.

19. The method of claim 17, wherein the second row of knots is aligned with the first row of knots when the second false eyelash placed on the second layer of double sided tape.

* * * * *